US008567475B2

(12) United States Patent
Boone

(10) Patent No.: US 8,567,475 B2
(45) Date of Patent: Oct. 29, 2013

(54) OVERHEAD GATE SYSTEMS

(76) Inventor: Kenneth Eugene Boone, Springfield, OR (US)

( * ) Notice: Subject to any disclaimer, the term of this patent is extended or adjusted under 35 U.S.C. 154(b) by 73 days.

(21) Appl. No.: 13/100,946

(22) Filed: May 4, 2011

(65) Prior Publication Data

US 2012/0279129 A1 Nov. 8, 2012

(51) Int. Cl.
*E06B 7/28* (2006.01)

(52) U.S. Cl.
USPC ..... 160/180; 160/201; 160/89; 160/229.1; 259/73; 259/26; 49/197

(58) Field of Classification Search
USPC ..... 160/113, 87, 201, 116, 205, 89, 107, 160/180, 229.1, 218; 256/26, 73, 24; 49/197
See application file for complete search history.

(56) References Cited

U.S. PATENT DOCUMENTS

| | | | | |
|---|---|---|---|---|
| 702,146 | A | 6/1902 | McCloud | |
| 1,965,262 | A | 10/1933 | Seregi | |
| 2,019,851 | A | 11/1935 | Hall | |
| 2,200,727 | A * | 5/1940 | Swenson | 49/73.1 |
| 2,563,894 | A * | 8/1951 | White | 49/226 |
| 3,044,540 | A * | 7/1962 | Hammersley | 160/20 |
| 3,648,755 | A * | 3/1972 | Thiele | 160/201 |
| 4,231,412 | A | 11/1980 | Nowak | |
| 4,378,043 | A | 3/1983 | Sorenson | |
| 4,519,164 | A * | 5/1985 | Porter | 49/108 |
| D297,463 | S | 8/1988 | Greco | |
| D297,572 | S | 9/1988 | Greco | |
| D297,573 | S | 9/1988 | Greco | |
| 4,770,087 | A | 9/1988 | Danley et al. | |
| D301,621 | S | 6/1989 | Muntz et al. | |
| 4,858,383 | A | 8/1989 | Kendig | |
| 5,579,608 | A * | 12/1996 | Dunn | 49/404 |
| 5,611,382 | A * | 3/1997 | Sferra | 160/113 |
| 5,860,465 | A | 1/1999 | Eastridge et al. | |
| 5,904,199 | A | 5/1999 | Messner | |
| 5,927,368 | A * | 7/1999 | Rohrer et al. | 160/201 |

(Continued)

FOREIGN PATENT DOCUMENTS

| | | |
|---|---|---|
| EP | 0200139 | 11/1986 |
| EP | 1911901 | 4/2008 |

(Continued)

OTHER PUBLICATIONS

"Guillotine (vertical) Gate". International KIKO Goat Association. http://www.theikga.org/homemade_goat_equipment.html.*

(Continued)

*Primary Examiner* — Katherine Mitchell
*Assistant Examiner* — Johnnie A Shablack
(74) *Attorney, Agent, or Firm* — DASCENZO Intellectual Property Law, P.C.

(57) ABSTRACT

Overhead gate systems include a gate assembly having a barrier and that defines a passage. When in a deployed configuration, the barrier is adjacent to the ground and restricts ingress to and egress from the installation site, and the passage is distal the ground surface relative to the barrier, permitting access to and from the installation site via the passage. When in a stowed configuration, the barrier is not adjacent to the ground surface and does not restrict ingress to and egress from the installation site.

33 Claims, 2 Drawing Sheets

(56) References Cited

U.S. PATENT DOCUMENTS

| | | | | |
|---|---|---|---|---|
| 6,026,886 | A * | 2/2000 | Diamond-Martinez | 160/113 |
| 6,062,293 | A * | 5/2000 | Berger, Jr. | 160/229.1 |
| 6,148,896 | A * | 11/2000 | Pinto et al. | 160/229.1 |
| 6,427,632 | B1 * | 8/2002 | Horst et al. | 119/518 |
| 6,557,614 | B1 | 5/2003 | Lampers | |
| D500,857 | S | 1/2005 | Miller et al. | |
| 6,951,237 | B2 * | 10/2005 | Mullet | 160/201 |
| 7,017,643 | B2 * | 3/2006 | Leum | 160/113 |
| 7,086,442 | B1 | 8/2006 | Esparza | |
| 7,100,339 | B2 * | 9/2006 | Hagel | 52/656.4 |
| 7,111,660 | B2 * | 9/2006 | Hartmann | 160/201 |
| 7,134,471 | B2 * | 11/2006 | Bennett et al. | 160/201 |
| 7,143,803 | B2 | 12/2006 | Mitchell | |
| 7,219,392 | B2 * | 5/2007 | Mullet et al. | 16/96 R |
| 7,308,926 | B1 | 12/2007 | Hawkins | |
| 7,509,990 | B1 | 3/2009 | Milligan | |
| 7,665,504 | B2 * | 2/2010 | Schulze | 160/201 |
| 7,726,378 | B1 * | 6/2010 | Savon | 160/201 |
| 7,748,429 | B2 * | 7/2010 | Caire et al. | 160/113 |
| 7,775,251 | B2 * | 8/2010 | Ward | 160/89 |
| 7,784,520 | B2 * | 8/2010 | Paulson | 160/201 |
| 7,832,451 | B2 | 11/2010 | Miller et al. | |
| 8,091,607 | B2 * | 1/2012 | Aquilina | 160/201 |
| 2002/0056528 | A1 * | 5/2002 | Whitley | 160/201 |
| 2004/0221968 | A1 | 11/2004 | Peterson | |
| 2005/0092447 | A1 * | 5/2005 | Mock | 160/201 |
| 2005/0150610 | A1 * | 7/2005 | Bennett et al. | 160/201 |
| 2007/0181267 | A1 * | 8/2007 | Mullet | 160/201 |
| 2010/0077664 | A1 * | 4/2010 | Stensland | 49/197 |

FOREIGN PATENT DOCUMENTS

| | | |
|---|---|---|
| FR | 2867220 | 9/2005 |
| JP | 7269142 | 10/1995 |
| JP | 8135350 | 5/1996 |
| JP | 2000265766 | 9/2000 |
| JP | 2004270310 | 9/2004 |
| JP | 2007085077 | 4/2007 |
| JP | 2008208674 | 9/2008 |

OTHER PUBLICATIONS

English-language abstract of Japanese Patent Publication No. JP 2008208674, JPO&INPIT, 2008.

English translation of Japanese Patent Publication No. JP 2008208674, downloaded from www.jpo.go.jp on or about Jan. 31, 2011.

English-language abstract of European Patent No. EP 1911901, downloaded from www.ep.espacenet.com on or about Apr. 28, 2011.

English-language abstract of Japanese Patent Publication No. JP 2007085077, JPO&IPIT, 2007.

English translation of Japanese Patent Publication No. JP 2007085077, downloaded from www.jpo.go.jp on or about Jan. 31, 2011.

English-language abstract of French Patent No. FR 2867220, downloaded from www.ep.espacenet.com on or about Feb. 10, 2011.

English-language abstract of Japanese Patent Publication No. JP 2004270310, JPO&NCIPI, 2004.

English translation of Japanese Patent Publication No. JP 2004270310, downloaded from www.jpo.go.jp on or about Jan. 31, 2011.

English-language abstract of Japanese Patent Publication No. JP 2000265766, downloaded from www.ep.espacenet.com on or about Feb. 10, 2011.

English translation of Japanese Patent Publication No. JP2000265766, downloaded from www.jpo.go.jp on or about Jan. 31, 2011.

English-language abstract of Japanese Patent Publication No. JP 8135350, downloaded from www.ep.espacenet.com on or about Feb. 10, 2011.

English translation of Japanese Patent Publication No. JP 8135350, downloaded from www.jpo.go.jp on or about Jan. 31, 2011.

English-language abstract of Japanese Patent Publication No. JP 7269142, downloaded from www.ep.espacenet.com on or about Feb. 10, 2011.

English translation of Japanese Patent Publication No. JP 7269142, downloaded from www.jpo.go.jp on or about Jan. 31, 2011.

"Carport Gates," Feb. 14, 2010, downloaded from http://metalcarportsandcarportkits.com/carport-gates/ on or about Feb. 2, 2011.

"Carport Gate," Mar. 13, 2010, downloaded from http://metalcarportsandcarportkits.com/carport-gate/ on or about Feb. 2, 2011.

Garage door parts diagram downloaded from the Internet on or about Mar. 18, 2011.

* cited by examiner

OVERHEAD GATE SYSTEMS

FIELD

The present disclosure relates to overhead gates.

BACKGROUND

In typical mobile, or manufactured, home communities, the homes are positioned very close to an adjacent street, and a carport, or side-awning, is often installed over a parking strip, or driveway, positioned to the side of a typical manufactured home. Community rules and the expense generally prohibit enclosing a manufactured home's carport to form a fully-enclosed garage.

Because typical manufactured home sites may not include a yard, or at least not an extensive yard, the home's carport is often used as an extension of the living space of the home. For example, it is common for children and pets to play on the parking strip under the side-awning. Moreover, because of the proximity to the adjacent street and/or typical community rules, typical swinging gates generally cannot be installed to enclose a manufactured home's carport, for example, to permit children and pets to play without worry of them running into the adjacent street.

SUMMARY

Overhead gate systems according to the present disclosure include a gate assembly that, when installed, restricts ingress to and egress from an installation site, such as a carport, proximate a ground surface, but permits access to and from the installation site distal the ground surface. That is, gate assemblies according to the present disclosure define a passage that is positioned above a barrier.

In some embodiments of overhead gate systems according to the present disclosure, the gate assembly includes a barrier, a bridge member above the barrier, at least one left linkage and at least one right linkage interconnecting the bridge member to the barrier. In some such embodiments, the passage is defined between the barrier, the bridge, and the left and right linkages.

DETAILED DESCRIPTION

Figure 1:
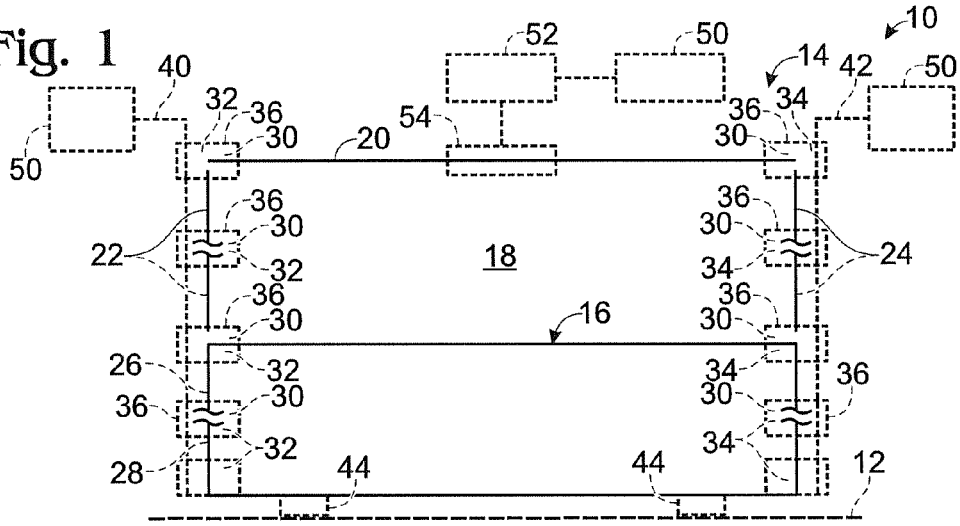
FIG. 1 is a schematic diagram representing overhead gate systems according to the present disclosure.

Overhead gate systems according to the present disclosure are schematically illustrated in FIG. 1 and generally indicated at 10. Overhead gate systems 10 according to the present disclosure also may be described as being for a carport, as being associated with a carport, as being for a carport associated with a mobile, or manufactured, home, as being for installation within a carport, and/or as being for installation under a side-awning, or canopy, of a mobile, or manufactured, home. However, overhead gate systems 10 are not limited to being used with carports and/or under side-awnings and canopies of manufactured homes and may be used for any suitable application. "Installation site," as used herein, refers to any suitable site, or location, for installation of an overhead gate system 10, including (but not limited to) carports (whether associated with a manufactured home or not), under side-awnings or canopies of manufactured homes, garages, etc.

Overhead gate systems 10 according to the present disclosure are described as "overhead," because systems 10 include a gate, or barrier, that is configured to be selectively raised and lowered by a user to and from an overhead position, respectively. That is, systems 10 may be described as having a deployed, or lowered, configuration, in which a barrier portion of the system restricts access to and from an installation site, and a stowed, or raised, configuration, in which the barrier portion of the system is positioned "overhead" within the installation site so that access is not restricted to and from the installation site by the barrier.

In FIG. 1, systems 10 are schematically illustrated in the deployed configuration, in so far as a ground surface 12 is schematically represented in FIG. 1 and with a portion of the gate assembly being adjacent to the ground surface; however, as discussed herein, systems 10, when installed, are selectively reconfigurable between a deployed configuration and a stowed configuration, and FIG. 1 schematically represents both of a deployed configuration and a stowed configuration of systems 10.

As schematically illustrated in FIG. 1, systems 10 include a gate assembly 14 that includes a barrier 16 that is adjacent to (and in some embodiments is in contact with) the ground surface when the system is in its deployed configuration. The barrier restricts, but does not necessarily prevent, ingress to and egress from the installation site (e.g., a carport) when the system is in its deployed configuration. The barrier does not prevent ingress to and egress from the installation site, because the gate assembly defines a passage 18 that is distal, or spaced away, from ground surface 12 and that is above the barrier when the system is in its deployed configuration. Passage 18 also may be described as a void, or space, defined by the gate assembly, and which permits access to and from the site of installation of a system 10. By permitting access, it is meant that the gate assembly, and in particular the barrier, does not fully enclose or block access to the installation site, nor does it prevent objects to pass to and from the installation site through the passage defined by the gate assembly. Stated differently, while the barrier may restrict a person from walking in and out of the installation site via the region of the gate assembly, a person may still pass objects over the barrier and/or even climb over the barrier when the system is in its deployed configuration. This deployed configuration of systems 10 according to the present disclosure is in stark contrast to typical residential garage door systems that are designed and installed to prevent access to and from a garage when in a deployed, or lowered, configuration, by securing the garage and preventing a person from entering and exiting the garage.

Passage 18 may be described in terms of spanning a portion of the height of the gate assembly. For example, in FIG. 1, passage 18 is schematically represented as having a height approximately equal to a height of barrier 16, and therefore a height of approximately 50% of an overall height of the gate assembly. However, the passage may have any suitable height in relation to the gate assembly, and FIG. 1 is intended to schematically represent any and all such heights. As illustrative, non-exclusive examples, the passage may span one or more of at least 10%, at least 20%, at least 30%, at least 40%, at least 50%, at least 60%, at least 70%, at least 90%, 10-90%, 10-80%, 10-70%, 10-60%, 10-50%, 10-40%, 10-30%, 10-20%, 20-90%, 20-80%, 20-70%, 20-60%, 20-50%, 20-40%, 20-30%, 30-90%, 30-80%, 30-70%, 30-60%, 30-50%, 30-40%, 40-90%, 40-80%, 40-70%, 40-60%, 40-50%, 50-90%, 50-80%, 50-70%, 50-60%, 60-90%, 60-80%, 60-70%, 70-90%, or 70-80% of a height of the gate assembly.

As used herein, relative terms such as upper, lower, left, right, etc. may be used to refer to gate assembly 14, its component parts, and/or to other components of systems 10, with these relative terms typically applying to a view of the gate assembly from outside and in front of and looking toward an installation site of a system 10 and with the system in its deployed configuration. For example, in the illustrative, non-exclusive example of a system 10 according to the present disclosure being installed within a carport, such relative terms relate to a person standing in front of the carport, looking into the carport (e.g., on the adjacent street in front of a typical manufactured home in a typical manufactured home community). Similarly, when referring to the height of a gate assembly or a portion or component thereof, such as the passage defined by the gate assembly, the height is indicative of a dimension when the system is in the deployed configuration and thus the gate assembly is in a deployed, or lowered, position.

When a system 10 is in its stowed, or raised, configuration, barrier 16 does not restrict ingress to and egress from the installation site. This is because when a system is in its stowed configuration, the barrier has been selectively raised and translated away from its lowered position so that it is not adjacent to the ground surface, and so that it is in an overhead position relative to the installation site, as discussed herein.

As schematically illustrated in FIG. 1, gate assemblies 14 according to the present disclosure may additionally include a bridge member 20 and at least one left linkage 22 and at least one right linkage 24 interconnecting the bridge member to barrier 16. That is, one or more left linkages 22, when present, interconnect the left side of the bridge member to the left side of the barrier. Similarly, one or more right linkages 24, when present, interconnect the right side of the bridge member to the right side of the barrier. In FIG. 1, the double wavy lines schematically represent that gate assemblies 14 may include one or more of such linkages and that such linkages may be of any suitable length. As illustrative, non-exclusive examples, gate assemblies 14 may include zero, one, two, three, four, or more than four of each of left and right linkages interconnecting the bridge member to the barrier. When left and right linkages are present, a left linkage is not directly connected to a right linkage. Rather, passage 18 is at least partially defined between the left and right linkages.

The bridge member is so named because it bridges the upper portion of the gate assembly and spans from the left side of the gate assembly to the right side of the gate assembly. A bridge member may additionally or alternatively be described as, or as including, a spanning member, an upper beam, an upper structural member, or any other suitable descriptive name as understood from the present disclosure.

As also schematically illustrated in FIG. 1 with double wavy lines, barriers 16 according to the present disclosure may have any suitable height and, in some embodiments, may include more than one section, such as including at least an upper section 26 and a lower section 28. As illustrative, non-exclusive examples, barriers 16 may include one, two, three, four, or more than four sections that collectively define a barrier of a gate assembly according to the present disclosure. The sections additionally or alternatively in some embodiments may be described as panels of a barrier and/or as barrier sections.

Barrier 16 may additionally or alternatively be described as a gate, or a gate portion, of the gate assembly 14. Moreover, the barrier in some embodiments may be constructed of a standard, or typical, gate, such as a gate that is available for purchase and typically used for installation to provide access through a fence. That is, a "standard gate," as used herein, refers to a gate that may be purchased and repurposed for utilization in a system 10 according to the present disclosure. As an illustrative, non-exclusive example, a standard gate may be constructed of wood and may include horizontal and/or vertical slats, or members. The repurposing of such a standard gate may include cutting the standard gate into two or more horizontal sections, such as corresponding to at least an upper section 26 and a lower section 28 of a barrier 16. Other configurations and materials of standard gates are also within the scope of the present disclosure, including, for example, gates constructed of metal or plastic, gates having configurations other than with horizontal and vertical slats, etc.

As schematically illustrated in FIG. 1, a barrier optionally may include one or more bumpers 44 positioned on a lower edge of barrier 16, so that when the system is in the deployed configuration, bumper(s) 44 engage ground surface 12. Accordingly, bumpers 44 may additionally or alternatively be described as ground-contacting members 44. Bumpers may be constructed of any suitable material, with rubber being an illustrative, non-exclusive example, and providing a shock-absorbing, or cushioning, effect when the system is being configured to its deployed configuration.

When a gate assembly 14 according to the present disclosure includes all of a barrier 16, a bridge member 20, one or more left linkages 22, and one or more right linkages 24, passage 18 may be described as being defined between the barrier, the bridge member, and the left and right linkages. However, in embodiments that do not include left and right linkages, but that include a barrier and a bridge member, the passage may be described as being defined between the barrier and the bridge member. In FIG. 1, passage 18 is schematically represented as generally rectangular; however, any suitable shape and configuration of passage 18 is within the scope of the present disclosure, including regular shapes and irregular shapes. As an illustrative, non-exclusive example, in some embodiments, an upper portion of the barrier may be described as extending into the passage, for example, with an upper portion of the barrier extending between a left linkage and a right linkage, when present.

Adjacent portions of gate assemblies 14 are hinged or otherwise coupled together so that adjacent portions are configured to pivot relative to each other. This hinged relationship is schematically represented in FIG. 1 with hinges 30 between the various components, including optional components, of gate assemblies 14. For example, when present, a left linkage 22 may be hinged to the left side of bridge member 20, and a right linkage 24 may be hinged to the right side of the bridge member. Two or more left linkages may be hinged together, and two or more right linkages may be hinged together. A left linkage, when present, may be hinged to the left side of barrier 16, and a right linkage, when present, may be hinged relative to the right side of the barrier. Accordingly, as described herein, when a system 10 is selectively reconfigured between a deployed configuration and a stowed configuration, the various adjacent portions of the gate assembly will pivot relative to each other as the portions pass along a transitional section.

Still referring to FIG. 1, gate assemblies 14 according to the present disclosure, in some embodiments, may include a plurality of left sliders 32 operatively connected to and extending from the left of one or more of the left side of barrier 16, the left side of bridge member 20, and the one or more left linkages 22. Similarly, gate assemblies 14 may include a plurality of right sliders 34 operatively connected to and extending from the right of one or more of the right side of the barrier, the right side of the bridge member, and the one or more right linkages 24. A "slider," as used herein is a structure that is configured to translate relative to another structure. For example, as an illustrative, non-exclusive example, a slider may include a roller, or wheel, that is configured to translate along a track. Additionally or alternatively, a slider may include a pin, or other projection, that is configured to translate along a track. Other configurations are also within the scope of "slider" as used herein, and the present disclosure is not limited to sliders including rollers and/or or pins.

In some embodiments, as schematically illustrated in FIG. 1, a slider, when present, may be a component of a hinge assembly 36. Stated differently, a slider 32, 34 and a hinge 30 may collectively define an assembly 36, with such an assembly additionally or alternatively being described as a hinge and slider assembly. For example, in some embodiments, a slider may include an axle that defines the axis of the hinge, and thus the axis of the hinged relationship between two adjacent interconnected components of a gate assembly 14. Other configurations are also within the scope of the present disclosure, including gate assemblies with sliders that are separate and apart from hinges and that are mounted independently to components of a gate assembly 14.

Systems 10 according to the present disclosure additionally may include, or may be configured for use with, a left track 40 and a right track 42. As schematically illustrated in FIG. 1, the left track, when present, is disposed left of the gate assembly, and the right track, when present, is disposed right of the gate assembly. Accordingly, the plurality of left sliders 32 may be operatively positioned with respect to and engaged with, or received in, the left track, and the plurality of right sliders 34 may be operatively positioned with respect to and engaged with, or received in, the right track, so that the sliders may translate along and relative to the tracks.

Tracks 40, 42 each include a vertical section, a substantially horizontal section, and a transitional section between the vertical section and the substantially horizontal section. As an illustrative, non-exclusive example, tracks according to the present disclosure may be configured similarly or identically to tracks of standard, or typical, residential garage door systems; however, tracks according to the present disclosure are not limited to such. The transitional section may be curved, for example, permitting a smooth transition between the deployed and stowed configurations as the sliders translate along the tracks. By "substantially horizontal" it is meant that the upper section of the tracks are either horizontal or near horizontal. With respect to the latter option of near horizontal, in some embodiments, it may be suitable or appropriate (but not required) for the upper section of the tracks to slope slightly down and backwards (as viewed from in front of the installation site looking toward the installation site). For example, by having this downwardly sloped upper section to the tracks, gravity may help to retain the gate assembly in the stowed configuration so that it is not easily and/or accidentally reconfigured from the stowed configuration to the deployed configuration. Such a configuration may be particularly well suited for a manually operated system 10, as discussed herein.

Accordingly, in a configuration of systems 10 that include, or that are adapted to be used with, sliders and tracks, the gate assembly may be selectively reconfigured between the stowed configuration and the deployed configuration along the tracks and through the transitional section of the tracks. As the gate assembly passes through the transitional section, the adjacent hinged components of the gate assembly will pivot relative to each other. For example, bridge member 20 will pivot relative to at least barrier 16, and in embodiments that include left and right linkages, the bridge member will pivot relative to an adjacent left linkage and an adjacent right linkage, and the barrier will pivot relative to an adjacent left linkage and an adjacent right linkage. Moreover, in embodiments that include more than one of a left linkage and a right linkage, such adjacent linkages will pivot with respect to each other as they translate along the transitional section of the tracks. Similarly, in embodiments that include a barrier with more than one section, the adjacent sections of the barrier will pivot with respect to each other as they translate along the transitional section of the tracks.

Still referring to FIG. 1, systems 10 according to the present disclosure may include, or may be adapted to be used in conjunction with, a frame 50 for supporting one or more components of a system 10. For example, in FIG. 1, tracks 40, 42 are schematically illustrated as being supported by frame 50. Other components, as discussed herein, also may be supported by the frame. Depending on the installation site of a system 10, the frame may include supporting members specifically installed for the purpose of installing a system 10 and/or may include existing support members, such as that are already present at an installation site prior to installation of a system 10. For example, in the illustrative, non-exclusive example of a system 10 being installed within a carport, the carport's existing structural members may form a portion of a frame 50, and thus may be used to support one or more components of a system 10, such as tracks 40, 42. Additionally or alternatively, and as mentioned, a frame may include one or more support members that are separate and apart from existing support members of an installation site. Additionally or alternatively, a frame may include existing support members that are reinforced for the purpose of installing a system 10 and supporting one or more components of the system. Illustrative, non-exclusive examples of support members that may be included in a frame include (but are not limited to) overhead beams; exterior walls of a mobile, or manufactured, home; carport, canopy, or awning support columns; etc.

Systems 10 according to the present disclosure may be configured as, or described as, manual systems, or manually operated systems, such that a user may manually and selectively raise and lower gate assembly 14 between a deployed position and an overhead position, for example, simply by grasping manually a portion of the gate assembly and raising and lowering it. Additionally or alternatively, however, some systems 10 may include, or may be configured to be used with, an overhead drive mechanism 52, such as a motorized drive mechanism. As schematically illustrated in FIG. 1, overhead drive mechanism 52, when present, may be supported by frame 50, such as an overhead beam of the frame. In such embodiments that include or that are configured to be used with an overhead drive mechanism, bridge member 20 of the gate assembly may include a mount, or mounting structure, 54 for operatively connecting the gate assembly to the overhead drive mechanism. This is schematically illustrated in FIG. 1 and may take any suitable form depending on the configuration of overhead drive mechanism being utilized. Other configurations are also within the scope of the present disclosure, including systems in which an overhead drive mechanism is configured to be operatively connected to a portion of the gate assembly other than, or in addition to, the bridge member.

In some embodiments, the overhead drive mechanism may be a standard overhead drive mechanism, such as readily available and marketed as a residential overhead garage door mechanism, often referred to as garage door openers, motorized garage door openers, or electric garage door openers. Such typical garage door openers typically include (but are not limited to including) a belt-driven, a chain-driven, or a screw-driven mechanism. Standard overhead drive mechanisms also typically include, or are configured for use with, a wall-mounted activation button and/or a hand-held activation button, with the button configured to selectively actuate the drive mechanism to raise and/or lower an associated garage door, or in the context of the present disclosure, a gate assembly 14. Other types and configurations of overhead drive mechanisms are within the scope of the present disclosure, and the present disclosure is not limited to standard, or typical, overhead drive mechanisms, such as typically used with garage doors.

Figure 2:
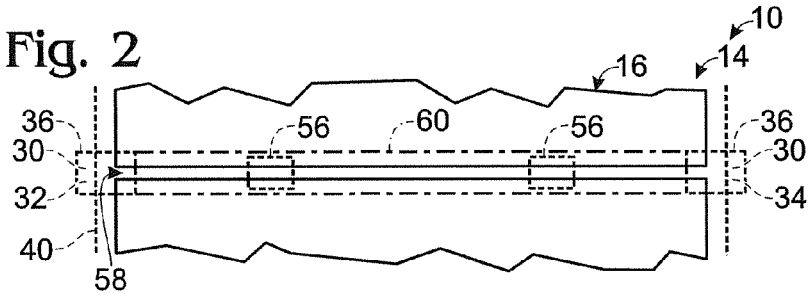
FIG. 2 is a schematic diagram representing a portion of overhead gate systems according to the present disclosure.

Turning now to FIG. 2, a portion of a gate assembly 14, including a portion of a barrier 16, is schematically illustrated, with the represented barrier including more than one barrier section hinged together. In addition to the hinges 30, with hinges 30 optionally forming hinge assemblies 36 together with left and right sliders 32, 34, barriers 16 may additionally or alternatively include one or more hinges 56 hinging together adjacent sections of the barrier, with such hinges 56 optionally being spaced across the width of the gate assembly.

In some embodiments, depending on the configuration of a barrier 16 that includes more than one section, a gap 58 may be defined between adjacent barrier sections. Depending on the nature, or configuration, of the gap, such as the size of the gap, the look of the gap in relation to the overall gate assembly (e.g., the color, texture, or other appearance of the barrier), the gap may detract from the overall appearance of the barrier. Accordingly, in some embodiments (although not required), one or more face covers 60 may be provided to conceal the gap(s), as schematically illustrated in FIG. 2 in dash-dot lines. By conceal a gap between adjacent barrier sections, it is meant that a face cover, when present, may generally obstruct a view of the respective gap, when viewed from outside and in front of the installation site looking at the barrier with the system in the deployed configuration. Including one or more face covers may be useful for configurations of barriers that are configured to resemble, or that are constructed and modified from, a standard gate. For example, a face cover may be configured to resemble a horizontal slat, or member, of a standard gate; however, other configurations are also within the scope of the present disclosure.

Face covers 60 are not limited to being used for, or a component of, a barrier 16, and may additionally or alternatively be used with any adjacent hinged components of a gate assembly 14. For example, a face cover may be used to conceal a gap between adjacent left or right linkages, between the bridge member and an adjacent left or right linkage, and/or between the barrier and an adjacent left or right linkage. When present, a face cover may be coupled to either of the upper or lower of two adjacent components, so that when the gate assembly passes along the transitional section of the tracks and the adjacent components pivot relative to each other, the face cover will pivot away from the respective gap. As an illustrative, non-exclusive example, a face cover may be riveted or otherwise secured or mounted to one of the upper or lower adjacent component.

Figure 3:
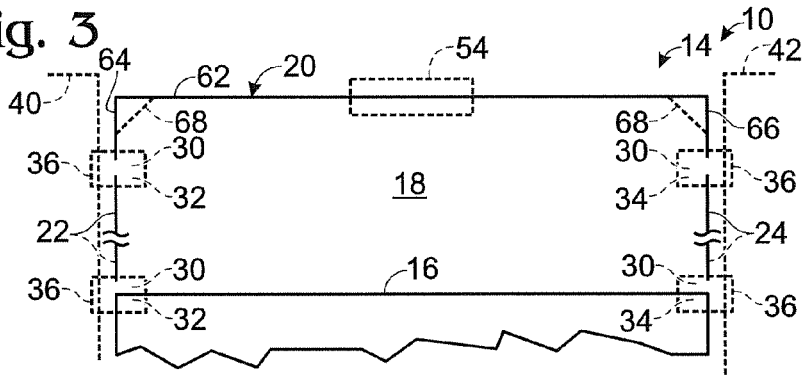
FIG. 3 is a schematic diagram representing a portion of overhead gate systems according to the present disclosure.

In FIG. 3, an illustrative, non-exclusive example of a bridge member 20 is schematically illustrated together with a portion of a barrier 16. In the illustrated non-exclusive example, the bridge member includes a spanning member 62, a left arm 64 extending from the spanning member on the left side of the bridge member, and a right arm 66 extending from the spanning member on the right side of the bridge member. Such a construction (although not required) may be utilized so that the bridge member is configured to better distribute applied loads from an associated overhead drive mechanism, when present. Additionally, one or more optional corner reinforcement members 68 may be provided to further strengthen the bridge member, as schematically and optionally illustrated in dashed lines in FIG. 3.

When a bridge member 20 according to the present disclosure includes optional left arm 64 and right arm 66, passage 18 may be described as being at least partially between, or as being at least partially defined by, the left and right arms of the bridge member. Moreover, as schematically illustrated in FIG. 3, when the left and right arms are present, they may be coupled to an adjacent left linkage 22 and an adjacent right linkage 24, respectively, for example, by a hinge 30 and optionally a hinge assembly 36.

Figure 4:
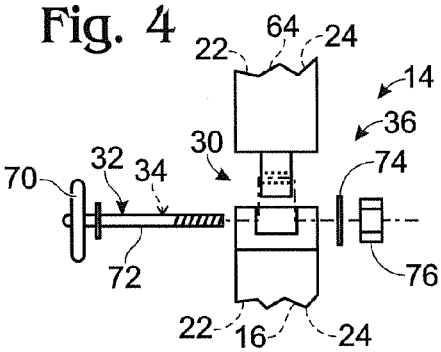
FIG. 4 is a front exploded view of a portion of an illustrative, non-exclusive example of an overhead gate system according to the present disclosure, including a hinge and roller assembly.

As discussed herein, it is within the scope of the present disclosure that a hinge assembly 36 may include both a hinge 30 and a slider 32, 34. FIG. 4 illustrates an illustrative, non-exclusive example of such a hinge assembly 36, in which a left slider 32 includes a roller, or wheel, 70 supported on an axle 72. Accordingly, the hinge assembly illustrated in FIG. 4 may be described as a hinge and roller assembly. While the reference numbers utilized in FIG. 4 correspond to the left side of a gate assembly (e.g., indicating a left slider 32), FIG. 4 is not so limiting and equally applies to the right side of a gate assembly.

As seen in FIG. 4, the hinge may be defined by adjacent components of a gate assembly 14. For example, as indicated by the optional reference numbers with dashed lead lines, a hinge assembly may be defined by two left linkages 22, by a left linkage and the barrier 16, by the left arm 64 of the bridge member and a left linkage, by the left arm and the barrier, etc. As mentioned, such configurations equally apply to right side counterparts of gate assemblies 14 according to the present disclosure.

A hinge assembly 36 may be described as having an axis defined by the hinged relationship between adjacent components of gate assembly 14, with the respective slider extending along the axis. In the illustrated example of a slider in the form of a roller 70 with a threaded axle 72, the axle extends along the axis of the hinged relationship and is secured in place with a washer 74 and nut 76; however, other configurations are also within the scope of the present disclosure.

The illustrated configuration of hinge assembly 36 is only illustrative, and is not required to all embodiments according to the present disclosure. For example, it is within the scope of the present disclosure that a hinge 30 is completely separate and apart from a left or right slider 32, 34. For example, a slider may be mounted above or below a hinge that couples adjacent components of a gate assembly. Moreover, when one or more hinges 30 are incorporated into a hinge assembly 36, all hinges 30 of a gate assembly are not required to be incorporated into a hinge assembly 36.

Figure 5:
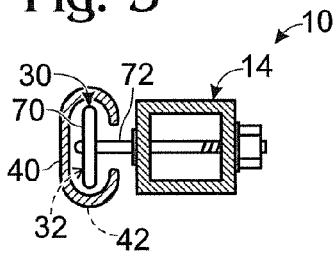
FIG. 5 is a top cross-sectional view of a portion of an illustrative, non-exclusive example of an overhead gate system according to the present disclosure, including a roller.

Turning now to FIG. 5, an illustrative, non-exclusive example of a left slider 32 and left track 40 are depicted in cross-section to illustrate an example of the relationship between a roller and a track of a system 10. Similar to FIG. 4, the illustrated configuration of FIG. 5 equally applies to a right slider 34 and a right track 42.

Figure 6:
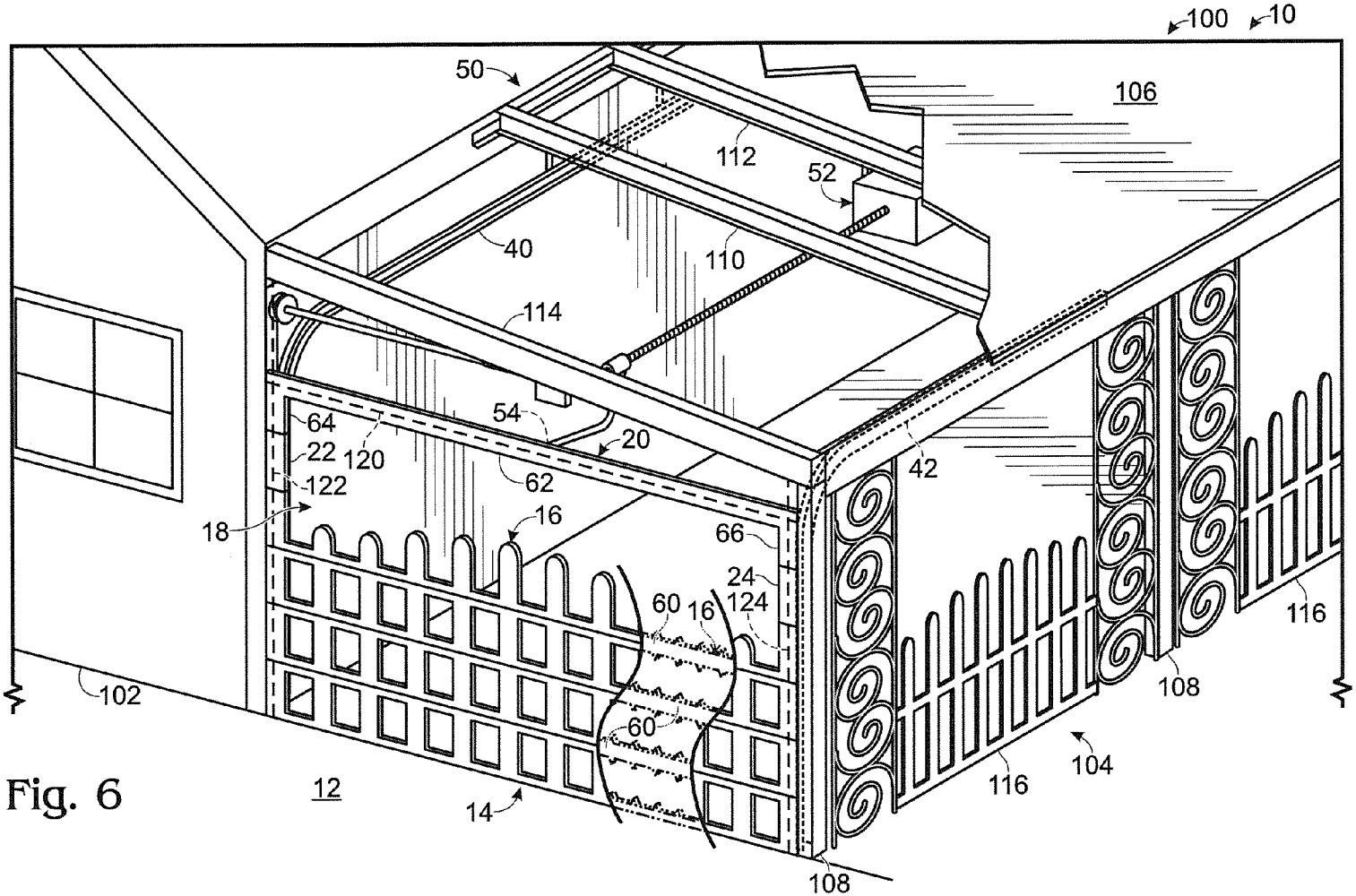
FIG. 6 is a perspective, partial cut-away view of an illustrative, non-exclusive example of an overhead gate system according to the present disclosure installed within a carport of a typical manufactured home.

In FIG. 6, an illustrative, non-exclusive example of a system 10 according to the present disclosure is illustrated and is indicated generally at 100. Where appropriate, the reference numerals from the schematic illustrations of FIGS. 1-3 are used to designate corresponding parts of system 100; however, the example of FIG. 6 is non-exclusive and does not limit the present disclosure to the illustrated embodiment. That is, neither systems 10 nor portions thereof are limited to the specific embodiment of system 100 illustrated in FIG. 6, and systems 10 according to the present disclosure may incorporate any number of the various aspects, configurations, characteristics, properties, etc. of system 100, of the schematically illustrated examples of systems 10 of FIGS. 1-3, of the examples of FIGS. 4-5, as well as variations thereof, without requiring the inclusion of all such aspects, configurations, characteristics, properties, etc. For the purpose of brevity, each previously discussed component, part, portion, aspect, region, section, etc. or variants thereof may not be discussed again with respect to system 100 of FIG. 6; however, it is within the scope of the present disclosure that the previously discussed features, variants, etc. may be utilized with system 100.

In FIG. 6, system 100 is illustrated in its deployed configuration and in conjunction with a home 102 having a carport 104 connected to the home. That is, carport 104 includes a roof 106 extending from the home and supported by a plurality of support members, or columns, 108. In FIG. 6, the roof is illustrated partially broken-away to better illustrate portions of system 100 installed within the carport. Home 102 may be described as a typical mobile, or manufactured, home, and carport 104 may additionally or alternatively be referred to as, or as including, a side-awning or canopy. However, systems 100 are not so limited and may be installed at any suitable installation site, including sites other than carports of manufactured homes.

As illustrated in FIG. 6, system 100 includes a gate assembly 14 that includes a barrier 16 defined by four barrier sections, or panels, that are hinged together, a left linkage 22, a right linkage 24, and a bridge member 20 defined by a spanning member 62, a left arm 64, and a right arm 66. The barrier of system 100 is configured to resemble a typical gate having vertical and horizontal slats, with the vertical slats having varying heights. In the illustrated example, the slats increase in height toward the center of the barrier, and therefore the barrier of system 100 may be described as having an upper center portion that extends into the passage 18 defined by the gate assembly.

An alternative embodiment of a barrier is partially illustrated in dashed lines between the two wavy lines in FIG. 6, with this alternative barrier including four barrier sections, similar to the more prominent example illustrated in FIG. 6. However, this alternative embodiment includes optional face covers 60 that conceal the gaps between the adjacent sections of the gate.

System 100 is illustrated with an overhead drive mechanism 52 of the screw-driven type, but as mentioned, any suitable drive mechanism may be used, or no drive mechanism may be used. In the illustrated example, system 100 is at least partially supported by a frame 50, including two overhead beams 110, 112 in the form of I-beams. In the illustrated example, the left and right tracks 40, 42 are supported by overhead beam 110, and the overhead drive mechanism is supported by overhead beam 112; however, as illustrated in dashed lines in FIG. 6, it is within the scope of the present disclosure that a single overhead beam 112 may be utilized to support both of the tracks and the overhead drive mechanism. A third overhead beam 114, representing an existing overhead beam of the illustrated carport for supporting roof 106, also may be within the scope of a frame 50 of a system 10 or 100 according to the present disclosure. For example, overhead beam 114 may be utilized to support a portion of the overhead drive mechanism, as may be appropriate depending on the configuration of overhead drive mechanism being utilized. All three of the illustrated overhead beams may be described as being angled relative to ground surface 12, such as being generally parallel to roof 106 of carport 104. However, it is also within the scope of the present disclosure that one or more of the overhead beams, when present, may be installed generally parallel to the ground surface. It is also within the scope of the present disclosure that the tracks and the drive mechanism of the overhead drive mechanism may be supported by existing structure of the installation site, without requiring installation of new support members.

The example of FIG. 6 also includes sections of fencing 116 extending along the side of the carport, and optionally along the rear of the carport as well. Accordingly, the fencing, together with gate assembly 14, restricts ingress to and egress from the carport. Moreover, although not required, the fencing may be constructed to correspond aesthetically to the construction of barrier 16 of system 100, such as illustrated in the example of FIG. 6.

Systems 10, including systems 100, according to the present disclosure may additionally (although are not required to) include one or more concealment panels positioned to at least partially conceal portions of the gate assembly and/or other portions or components of a system 10. For example, a system 10 may include an upper concealment panel 120, as schematically illustrated by the dashed line in FIG. 6 representing a lower most edge of such an upper concealment panel. When present, the upper concealment panel may at least partially conceal the drive mechanism and at least a portion of (and in some embodiments the entirety of) the bridge member 20 of the gate assembly when the system is in its deployed configuration. Such a configuration may be desired, for example, so that the system 10 is not recognized as an overhead gate system when viewed from a suitable position outside of and in front of the installation site and looking toward the installation site, with the carport of FIG. 6 being just one example of an installation site. Additionally or alternatively, inclusion of such optional concealment panels may make the installation of system 10 more aesthetically pleasing. The optional concealment panels may be constructed of any suitable material and may take any suitable form or configuration. As illustrative, non-exclusive examples, the concealment panels, when present, may be constructed of wood, vinyl, metal, composite material, etc. In some embodiments, the concealment panels may be configured to match, or otherwise blend in with, the construction of the installation site. As illustrative, non-exclusive examples, the concealment panels may be constructed of siding material (e.g., corresponding to the siding of a manufactured home) or of decorative metal work (e.g., corresponding to decorative metal work associated with a carport support column). Other configurations and forms of concealment panels are also within the scope of the present disclosure.

Additionally or alternatively, systems 10 may include one or both of a left concealment panel 122 and a right concealment panel 124 positioned to conceal at least a left portion and a right portion, respectively, of the gate assembly when viewed from outside and in front of the installation site. In FIG. 6, the side concealment panels are schematically illustrated by the dashed lines representing the inner edge of the respective panels.

Systems according to the present disclosure may additionally or alternatively be described in terms of a kit, with the kit including at least a subset, and in some examples all of, the various components of a system 10 according to the present disclosure. That is, a kit may be provided or sold for installation of a system 10 at an installation site, with the kit including one or more of the various components of systems 10 discussed herein.

Illustrative, non-exclusive examples of inventions according to the present disclosure are presented in the following enumerated paragraphs.

A An overhead gate system for an installation site, the overhead gate system having a deployed configuration and a stowed configuration, the overhead gate system comprising:

a gate assembly, wherein the gate assembly includes a barrier and defines a passage, wherein when the overhead gate system is in the deployed configuration, the barrier is adjacent to a ground surface and restricts ingress to and egress from the installation site and the passage is distal the ground surface relative to the barrier, permitting access to and from the installation site via the passage, and wherein when the overhead gate system is in the stowed configuration, the barrier is not adjacent to the ground surface and does not restrict ingress to and egress from the installation site, and wherein the barrier includes a left side and a right side.

A1 The overhead gate system of paragraph A, wherein the gate assembly further includes:

a bridge member, wherein the bridge member includes a left side and a right side;

at least one left linkage interconnecting the left side of the bridge member to the left side of the barrier, wherein the at least one left linkage is hinged to the left side of the bridge member and hinged to the left side of the barrier; and at least one right linkage interconnecting the right side of the bridge member to the right side of the barrier, wherein the at least one right linkage is hinged to the right side of the bridge member and hinged to the right side of the barrier;

wherein the passage is defined between the barrier, the bridge member, the at least one left linkage, and the at least one right linkage.

A1.1 The overhead gate system of paragraph A1, wherein the gate assembly further includes:

a plurality of left sliders operatively connected to and extending from the left of one or more of the left side of the barrier, the left side of the bridge member, and the at least one left linkage; and a plurality of right sliders operatively connected to and extending from the right of one or more of the right side of the barrier, the right side of the bridge member, and the at least one right linkage; and wherein the overhead gate system further comprises:

a left track disposed left of the left side of the barrier, the left side of the bridge member, and the at least one left linkage, wherein the plurality of left sliders are received in the left track and configured to selectively translate along the left track;

a right track disposed to the right of the right side of the barrier, the right side of the bridge member, and the at least one right linkage, wherein the plurality of right sliders are received in the right track and configured to selectively translate along the right track;

wherein the left track and the right track each include a vertical section, a substantially horizontal section, and a transitional section between the vertical section and the substantially horizontal section;

wherein the barrier, the bridge member, the at least one left linkage, and the at least one right linkage are configured to be selectively translated relative to and along the left track and the right track;

wherein the barrier, the bridge member, the at least one left linkage, and the at least one right linkage are adjacent to the vertical sections of the left track and the right track when the overhead gate system is in the deployed configuration, and are adjacent to the substantially horizontal section of the left track and the right track when the overhead gate system is in the stowed configuration; and wherein when the overhead gate system transitions between the deployed configuration and the stowed configuration, the bridge member pivots relative to the at least one left linkage and the at least one right linkage, and the barrier pivots relative to the at least one left linkage and the at least one right linkage as the bridge member, the at least one left linkage, the at least one right linkage, and the barrier pass along the transitional sections of the left track and the right track.

A1.2 The overhead gate system of any of paragraphs A1-A1.1, wherein the at least one right linkage is not directly connected to the at least one left linkage.

A1.3 The overhead gate system of any of paragraphs A1-A1.2, wherein the passage is at least partially between the at least one left linkage and the at least one right linkage.

A1.4 The overhead gate system of any of paragraphs A1-A1.3, wherein the bridge member includes:

a spanning member;

a left arm extending from the spanning member on the left side of the bridge member; and a right arm extending from the spanning member on the right side of the bridge member;

wherein the passage is at least partially between the left arm and the right arm.

A1.5 The overhead gate system of any of paragraphs A1-A1.4, wherein the at least one left linkage includes two or more left linkages hinged together and the at least one right linkage includes two or more right linkages hinged together; and wherein when the overhead gate system transitions between the deployed configuration and the stowed configuration, the two or more left linkages pivot relative to each other as the two or more left linkages pass along the transitional section of the left track, and the two or more right linkages pivot relative to each other as the two or more right linkages pass along the transitional section of the right track.

A1.5.1 The overhead gate system of paragraph A1.5, wherein the two or more left linkages include one of two, three, four, or more than four left linkages, and wherein the two or more right linkages include one of two, three, four, or more than four right linkages.

A1.6 The overhead gate system of any of paragraphs A1-A1.5.1, wherein the plurality of left sliders includes a first left slider that extends along an axis defined by the hinged relationship between the left side of the bridge member and the left side of the at least one left linkage, and a second left slider that extends along an axis defined by the hinged relationship between the at least one left linkage and the left side of the barrier; and wherein the plurality of right sliders includes a first right slider that extends along an axis defined by the hinged relationship between the right side of the bridge member and the right side of the at least one right linkage, and a second right slider that extends along an axis defined by the hinged relationship between the at least one right linkage and the right side of the barrier.

A1.6.1 The overhead gate system of paragraph A1.6 when depending from paragraph A1.5, wherein the plurality of left sliders further includes at least a third left slider that extends along an axis defined by the hinged relationship of the two or more left linkages; and wherein the plurality of right sliders further includes at least a third right slider that extends along an axis defined by the hinged relationship of the two or more right linkages.

A1.6.2 The overhead gate system of any of paragraphs A1.6-A1.6.1, wherein the plurality of left sliders includes a plurality of rollers, and wherein the plurality of right sliders includes a plurality of rollers.

A2 The overhead gate system of any of paragraphs A-A1.6.2, wherein the barrier is constructed of a standard gate.

A3 The overhead gate system of any of paragraphs A-A2, wherein the barrier includes at least two barrier sections that are hinged relative to each other.

A3.1 The overhead gate system of paragraph A3, wherein the at least two barrier sections include one of two, three, four, or more than four barrier sections.

A3.2 The overhead gate system of any of paragraphs A3-A3.1, wherein a gap is defined between adjacent sections of the at least two barrier sections, wherein the barrier further includes a face cover coupled to one section of an adjacent pair of the at least two barrier sections, wherein the face cover conceals the gap between the sections of the adjacent pair of the at least two barrier sections when viewed from outside and in front of the installation site and when the overhead gate system is in the deployed configuration.

A3.2.1 The overhead gate system of paragraph A3.2, wherein the face cover is configured to resemble a horizontal member of a standard gate.

A3.3 The overhead gate system of any of paragraphs A3-A3.2.1, wherein the barrier is constructed of a standard gate that has been modified to include the at least two barrier sections that are hinged relative to each other.

A3.4 The overhead gate system of any of paragraphs A3-A3.3 when depending from paragraph A1.6, wherein the plurality of left sliders further includes at least a third left slider that extends along an axis defined by the hinged relationship of the at least two barrier sections; and wherein the plurality of right sliders further includes at least a third right slider that extends along the axis defined by the hinged relationship of the at least two barrier sections.

A4 The overhead gate system of any of paragraphs A-A3.4, further comprising a frame for positioning within the installation site, wherein the gate assembly is supported by the frame.

A4.1 The overhead gate system of paragraph A4 when depending from paragraph A1.1, wherein the left track and the right track are supported by the frame.

A4.2 The overhead gate system of any of paragraphs A4-A4.1, wherein the frame includes at least one existing support member of the installation site.

A4.3 The overhead gate system of any of paragraphs A4-A4.2, wherein the frame includes at least one support member that is separate and apart from existing support members of the installation site.

A4.4 The overhead gate system of any of paragraphs A4-A4.3, wherein the frame includes reinforced existing support members of the installation site.

A4.5 The overhead gate system of any of paragraphs A4-A4.4, wherein the frame includes at least one overhead beam.

A4.5.1 The overhead gate system of paragraph A4.5 when depending from paragraph A1.1, wherein the substantially horizontal sections of the left track and the right track are supported by the at least one overhead beam.

A4.5.2 The overhead gate system of any of paragraphs A4.5-A4.5.1, wherein the at least one overhead beam is substantially horizontal.

A4.5.3 The overhead gate system of any of paragraphs A4.5-A4.5.1, wherein the at least one overhead beam is angled relative to the ground surface and is substantially parallel to a roof of the installation site.

A4.5.4 The overhead gate system of any of paragraphs A4.5-A4.5.3, wherein the at least one overhead beam is an I-beam.

A5 The overhead gate system of any of paragraphs A-A4.5.4, wherein the gate assembly includes a mount for operatively connecting the gate assembly to an overhead drive mechanism.

A5.1 The overhead gate system of paragraph A5 when depending from paragraph A1, wherein the bridge member includes the mount.

A5.2 The overhead gate system of any of paragraphs A5-A5.1, wherein the overhead drive mechanism includes a standard overhead garage door drive mechanism.

A5.3 The overhead gate system of any of paragraphs A5-A5.2, in combination with the overhead drive mechanism.

A5.3.1 The overhead gate system of paragraph A5.3 when depending from paragraph A4, wherein the overhead drive mechanism is supported by the frame.

A5.3.2 The overhead gate system of paragraph A5.3 when depending from paragraph A4.5, wherein the overhead drive mechanism is supported by the overhead beam.

A6 The overhead gate system of any of paragraphs A-A5.3.2, further comprising:

a fence for extending around at least two sides of the installation site and restricting ingress to and egress from the installation site.

A7 The overhead gate system of any of paragraphs A-A6, wherein the passage spans one or more of at least 10%, at least 20%, at least 30%, at least 40%, at least 50%, at least 60%, at least 70%, at least 90%, 10-90%, 10-80%, 10-70%, 10-60%, 10-50%, 10-40%, 10-30%, 10-20%, 20-90%, 20-80%, 20-70%, 20-60%, 20-50%, 20-40%, 20-30%, 30-90%, 30-80%, 30-70%, 30-60%, 30-50%, 30-40%, 40-90%, 40-80%, 40-70%, 40-60%, 40-50%, 50-90%, 50-80%, 50-70%, 50-60%, 60-90%, 60-80%, 60-70%, 70-90%, and 70-80% of a height of the gate assembly when the overhead gate system is in the deployed configuration.

A8 The overhead gate system of any of paragraphs A-A7, further comprising:

an upper panel positioned to conceal at least an upper portion of the gate assembly when viewed from outside and in front of the installation site and when the overhead gate system is in the deployed configuration.

A9 The overhead gate system of any of paragraphs A-A8, further comprising:

a left panel positioned to conceal at least a left portion of the gate assembly when viewed from outside and in front of the installation site and when the overhead gate system is in the deployed configuration.

A10 The overhead gate system of any of paragraphs A-A9, further comprising:

a right panel positioned to conceal at least a right portion of the gate assembly when viewed from outside and in front of the installation site when the overhead gate system is in the deployed configuration.

A11 The overhead gate system of any of paragraphs A-A10, wherein a portion (and optionally an upper central portion) of the barrier extends into the passage.

A12 The overhead gate system of any of paragraphs A-A11, wherein the installation site is defined by a standard awning of a mobile, or manufactured, home.

A12.1 The overhead gate system of paragraph A12 in combination with the home.

A13 The overhead gate system of any of paragraphs A-A12.1, wherein the installation site is a carport.

B A kit for an overhead gate system for an installation site, wherein the overhead gate system, when installed, has a deployed configuration and a stowed configuration, the kit comprising:

one or more of the components of the overhead gate system of any of paragraphs A-A13.

As used herein the terms "adapted" and "configured" when used to describe an element, component, or other subject matter, mean that the element, component, or other subject matter is designed and/or intended to perform the recited function. Thus, the use of the terms "adapted" and "configured" should not be construed to mean that a given element, component, or other subject matter simply is "capable of" performing the recited function. Rather, the element, component, and/or other subject matter is created specifically for the purpose of performing the recited function. It is also within the scope of the present disclosure that elements, components, and/or other subject matter that is recited as being configured to perform a particular function may additionally or alternatively be described as being adapted to perform that function, and vice versa.

The disclosure set forth above encompasses multiple distinct inventions with independent utility. While each of these inventions has been disclosed in its preferred form or method, the specific alternatives, embodiments, and/or methods thereof as disclosed and illustrated herein are not to be considered in a limiting sense, as numerous variations are possible. The present disclosure includes all novel and non-obvious combinations and subcombinations of the various elements, features, functions, properties, methods, and/or steps disclosed herein. Similarly, where any disclosure above or claim below recites "a" or "a first" element, step of a method, or the equivalent thereof, such disclosure or claim should be understood to include incorporation of one or more such elements or steps, neither requiring nor excluding two or more such elements or steps.

It is believed that the following claims particularly point out certain combinations and subcombinations that are directed to one of the disclosed inventions and are novel and non-obvious. Inventions embodied in other combinations and subcombinations of features, functions, elements, properties, methods, and/or steps may be claimed through amendment of the present claims or presentation of new claims in this or a related application. Such amended or new claims, whether they are directed to a different invention or directed to the same invention, whether different, broader, narrower, or equal in scope to the original claims, also are regarded as within the subject matter of the inventions of the present disclosure.

The invention claimed is:

1. An overhead gate system for an installation site, the overhead gate system having a deployed configuration and a stowed configuration, the overhead gate system comprising:

a gate assembly, wherein the gate assembly defines a passage and includes:

a barrier, wherein when the overhead gate system is in the deployed configuration, the barrier is adjacent to a ground surface and restricts ingress to and egress from the installation site and the passage is distal the ground surface relative to the barrier, permitting physical access to and from the installation site via the passage, and wherein when the overhead gate system is in the stowed configuration, the barrier is not adjacent to the ground surface and does not restrict ingress to and egress from the installation site, and wherein the barrier includes a left side and a right side;

a bridge member, wherein the bridge member includes a left side and a right side;

at least one left linkage interconnecting the left side of the bridge member to the left side of the barrier, wherein the at least one left linkage is hinged to the left side of the bridge member and hinged to the left side of the barrier; and at least one right linkage interconnecting the right side of the bridge member to the right side of the barrier, wherein the at least one right linkage is hinged to the right side of the bridge member and hinged to the right side of the barrier;

wherein the passage is defined between the barrier, the bridge member, the at least one left linkage, and the at least one right linkage.

2. The overhead gate system of claim 1, wherein the at least one right linkage is not directly connected to the at least one left linkage.

3. The overhead gate system of claim 1, wherein the bridge member includes:

a spanning member;

a left arm extending from the spanning member on the left side of the bridge member; and a right arm extending from the spanning member on the right side of the bridge member;

wherein the passage is at least partially between the left arm and the right arm.

4. The overhead gate system of claim 1, wherein the bridge member includes a mount for operatively connecting the gate assembly to an overhead drive mechanism.

5. The overhead gate system of claim 1, further comprising a frame for positioning within the installation site, wherein the gate assembly is supported by the frame, and wherein the frame includes at least one existing support member of the installation site.

6. The overhead gate system of claim 1, further comprising a frame for positioning within the installation site, wherein the gate assembly is supported by the frame, and wherein the frame includes at least one support member that is separate and apart from existing support members of the installation site.

7. The overhead gate system of claim 1, wherein the gate assembly includes a mount for operatively connecting the gate assembly to an overhead drive mechanism, and wherein the overhead gate system further comprises the overhead drive mechanism.

8. The overhead gate system of claim 1, further comprising:

a fence for extending around at least two sides of the installation site and restricting ingress to and egress from the installation site.

9. The overhead gate system of claim 1, wherein the passage spans 20-80% of a height of the gate assembly when the overhead gate system is in the deployed configuration.

10. The overhead gate system of claim 1, wherein the installation site is defined by a standard awning of a manufactured home, and wherein the overhead gate system further comprises the manufactured home.

11. The overhead gate system of claim 1, wherein the installation site is a carport.

12. The overhead gate system of claim 1, wherein the passage spans 40-80% of a height of the gate assembly when the overhead gate system is in the deployed configuration, and wherein the passage substantially spans a width of the gate assembly.

13. The overhead gate system of claim 1, wherein the gate assembly further includes:

a plurality of left sliders operatively connected to and extending from the left of one or more of (i) the left side of the barrier, (ii) the left side of the bridge member, and (iii) the at least one left linkage; and a plurality of right sliders operatively connected to and extending from the right of one or more of (i) the right side of the barrier, (ii) the right side of the bridge member, and (iii) the at least one right linkage; and wherein the overhead gate system further comprises:

a left track disposed left of the left side of the barrier, the left side of the bridge member, and the at least one left linkage, wherein the plurality of left sliders are received in the left track and configured to selectively translate along the left track; and a right track disposed to the right of the right side of the barrier, the right side of the bridge member, and the at least one right linkage, wherein the plurality of right sliders are received in the right track and configured to selectively translate along the right track;

wherein the left track and the right track each include a vertical section, a substantially horizontal section, and a transitional section between the vertical section and the substantially horizontal section;

wherein the barrier, the bridge member, the at least one left linkage, and the at least one right linkage are configured to be selectively translated relative to and along the left track and the right track;

wherein the barrier, the bridge member, the at least one left linkage, and the at least one right linkage are adjacent to the vertical sections of the left track and the right track when the overhead gate system is in the deployed configuration, and are adjacent to the substantially horizontal section of the left track and the right track when the overhead gate system is in the stowed configuration; and wherein when the overhead gate system transitions between the deployed configuration and the stowed configuration, the bridge member pivots relative to the at least one left linkage and the at least one right linkage, and the barrier pivots relative to the at least one left linkage and the at least one right linkage as the bridge member, the at least one left linkage, the at least one right linkage, and the barrier pass along the transitional sections of the left track and the right track.

14. The overhead gate system of claim 13, wherein the at least one left linkage includes two or more left linkages hinged together and the at least one right linkage includes two or more right linkages hinged together; and wherein when the overhead gate system transitions between the deployed configuration and the stowed configuration, the two or more left linkages pivot relative to each other as the two or more left linkages pass along the transitional section of the left track, and the two or more right linkages pivot relative to each other as the two or more right linkages pass along the transitional section of the right track.

15. The overhead gate system of claim 13, wherein the plurality of left sliders includes a first left slider that extends along an axis defined by the hinged relationship between the left side of the bridge member and the left side of the at least one left linkage, and a second left slider that extends along an axis defined by the hinged relationship between the at least one left linkage and the left side of the barrier; and wherein the plurality of right sliders includes a first right slider that extends along an axis defined by the hinged relationship between the right side of the bridge member and the right side of the at least one right linkage, and a second right slider that extends along an axis defined by the hinged relationship between the at least one right linkage and the right side of the barrier.

16. The overhead gate system of claim 13, wherein the barrier includes at least two barrier sections that are hinged relative to each other, wherein when the overhead gate system transitions between the deployed configuration and the stowed configuration, the at least two barrier sections pivot relative to each other as the at least two barrier sections pass along the transitional sections of the left track and the right track.

17. The overhead gate system of claim 16, wherein a gap is defined between adjacent barrier sections of the at least two barrier sections, wherein the barrier further includes a face cover coupled to one barrier section of an adjacent pair of the at least two barrier sections, wherein the face cover conceals the gap between the barrier sections of the adjacent pair of the at least two barrier sections when viewed from outside and in front of the installation site and when the overhead gate system is in the deployed configuration.

18. The overhead gate system of claim 16, wherein the barrier is constructed of a repurposed standard gate that has been modified to include the at least two barrier sections that are hinged relative to each other.

19. The overhead gate system of claim 16, wherein the at least two barrier sections that are hinged relative to each other define a hinge axis, and wherein when the overhead gate system is in the deployed configuration, neither a left slider nor a right slider extend along the hinge axis or along an axis that is at the same height as the hinge axis.

20. An overhead gate system for an installation site, the overhead gate system having a deployed configuration and a stowed configuration, the overhead gate system comprising:

a gate assembly, wherein the gate assembly defines a passage and includes:

a barrier, wherein when the overhead gate system is in the deployed configuration, the barrier is adjacent to a ground surface and restricts ingress to and egress from the installation site and the passage is distal the ground surface relative to the barrier, permitting physical access to and from the installation site via the passage, and wherein when the overhead gate system is in the stowed configuration, the barrier is not adjacent to the ground surface and does not restrict ingress to and egress from the installation site;

at least one left hinge positioned horizontally adjacent a left side of the passage; and at least one right hinge positioned horizontally adjacent a right side of the passage.

21. The overhead gate system of claim 20, further comprising a frame for positioning within the installation site, wherein the gate assembly is supported by the frame, and wherein the frame includes at least one existing support member of the installation site.

22. The overhead gate system of claim 20, further comprising a frame for positioning within the installation site, wherein the gate assembly is supported by the frame, and wherein the frame includes at least one support member that is separate and apart from existing support members of the installation site.

23. The overhead gate system of claim 20, wherein the gate assembly includes a mount for operatively connecting the gate assembly to an overhead drive mechanism, and wherein the overhead gate system further comprises the overhead drive mechanism.

24. The overhead gate system of claim 20, further comprising:

a fence for extending around at least two sides of the installation site and restricting ingress to and egress from the installation site.

25. The overhead gate system of claim 20, wherein the passage spans 20-80% of a height of the gate assembly when the overhead gate system is in the deployed configuration.

26. The overhead gate system of claim 20, wherein the installation site is defined by a standard awning of a manufactured home, and wherein the overhead gate system further comprises the manufactured home.

27. The overhead gate system of claim 20, wherein the installation site is a carport.

28. The overhead gate system of claim 20, wherein the passage spans 40-80% of a height of the gate assembly when the overhead gate system is in the deployed configuration, and wherein the passage substantially spans a width of the gate assembly.

29. An overhead gate system for an installation site, the overhead gate system having a deployed configuration and a stowed configuration, the overhead gate system comprising:

a gate assembly, wherein the gate assembly includes a barrier and defines a passage, wherein when the overhead gate system is in the deployed configuration, the barrier is adjacent to a ground surface and restricts ingress to and egress from the installation site and the passage is distal the ground surface relative to the barrier, permitting physical access to and from the installation site via the passage, and wherein when the overhead gate system is in the stowed configuration, the barrier is not adjacent to the ground surface and does not restrict ingress to and egress from the installation site, and wherein the barrier includes a left side and a right side; and an upper concealment panel positioned to conceal at least an upper portion of the gate assembly when viewed from outside and in front of the installation site and when the overhead gate system is in the deployed configuration.

30. An overhead gate system for an installation site, the overhead gate system having a deployed configuration and a stowed configuration, the overhead gate system comprising:

a gate assembly, wherein the gate assembly includes a barrier and defines a passage, wherein when the overhead gate system is in the deployed configuration, the barrier is adjacent to a ground surface and restricts ingress to and egress from the installation site and the passage is distal the ground surface relative to the barrier, permitting physical access to and from the installation site via the passage, and wherein when the overhead gate system is in the stowed configuration, the barrier is not adjacent to the ground surface and does not restrict ingress to and egress from the installation site, and wherein the barrier includes a left side and a right side;

a left concealment panel positioned to conceal at least a left portion of the gate assembly when viewed from outside and in front of the installation site and when the overhead gate system is in the deployed configuration; and a right concealment panel positioned to conceal at least a right portion of the gate assembly when viewed from outside and in front of the installation site when the overhead gate system is in the deployed configuration.

31. An overhead gate system for an installation site, the overhead gate system having a deployed configuration and a stowed configuration, the overhead gate system comprising:

a gate assembly, wherein the gate assembly includes a barrier and defines a passage, wherein when the overhead gate system is in the deployed configuration, the barrier is adjacent to a ground surface and restricts ingress to and egress from the installation site and the passage is distal the ground surface relative to the barrier, permitting physical access to and from the installation site via the passage, and wherein when the overhead gate system is in the stowed configuration, the barrier is not adjacent to the ground surface and does not restrict ingress to and egress from the installation site, wherein the barrier includes a left side and a right side, and wherein an upper central portion of the barrier extends into the passage.

32. An overhead gate system for a carport, the overhead gate system having a deployed configuration and a stowed configuration, the overhead gate system comprising:

a gate assembly, wherein the gate assembly includes:

a barrier and defines a passage, wherein when the overhead gate system is in the deployed configuration, the barrier is adjacent to a ground surface and restricts ingress to and egress from the carport and the passage is distal the ground surface relative to the barrier, permitting physical access to and from the carport via the passage, and wherein when the overhead gate system is in the stowed configuration, the barrier is not adjacent to the ground surface and does not restrict ingress to and egress from the carport, and wherein the barrier includes a left side and a right side;

a bridge member, wherein the bridge member includes a left side and a right side;

at least one left linkage interconnecting the left side of the bridge member to the left side of the barrier, wherein the at least one left linkage is hinged to the left side of the bridge member and hinged to the left side of the barrier;

at least one right linkage interconnecting the right side of the bridge member to the right side of the barrier, wherein the at least one right linkage is hinged to the right side of the bridge and hinged to the right side of the barrier, and wherein the at least one right linkage is not directly connected to the at least one left linkage;

a plurality of left sliders operatively connected to and extending from the left of one or more of the left side of the barrier, the left side of the bridge member, and the at least one left linkage; and a plurality of right sliders operatively connected to and extending from the right of one or more of the right side of the barrier, the right side of the bridge member, and the at least one right linkage;

a left track disposed left of the left side of the barrier, the left side of the bridge member, and the at least one left linkage, wherein the plurality of left sliders are received in the left track and configured to selectively translate along the left track; and a right track disposed to the right of the right side of the barrier, the right side of the bridge member, and the at least one right linkage, wherein the plurality of right sliders are received in the right track and configured to selectively translate along the right track;

wherein the left track and the right track each include a vertical section, a substantially horizontal section, and a transitional section between the vertical section and the substantially horizontal section;

wherein the barrier, the bridge member, the at least one left linkage, and the at least one right linkage are configured to be selectively translated relative to and along the left track and the right track;

wherein the barrier, the bridge member, the at least one left linkage, and the at least one right linkage are adjacent to the vertical sections of the left track and the right track when the overhead gate system is in the deployed configuration, and are adjacent to the substantially horizontal section of the left track and the right track when the overhead gate system is in the stowed configuration;

wherein when the overhead gate system transitions between the deployed configuration and the stowed configuration, the bridge member pivots relative to the at least one left linkage and the at least one right linkage, and the barrier pivots relative to the at least one left linkage and the at least one right linkage as the bridge member, the at least one left linkage, the at least one right linkage, and the barrier pass along the transitional sections of the left track and the right track; and wherein the passage is defined between the barrier, the bridge member, the at least one left linkage, and the at least one right linkage.

33. A kit for an overhead gate system for a carport, the overhead gate system, when installed, having a deployed configuration and a stowed configuration, the kit comprising:

a barrier for restricting ingress to and egress from the installation site proximate to a ground surface when the overhead gate system is assembled, installed, and in the deployed configuration, wherein the barrier includes a left side and a right side;

a bridge member, wherein the bridge member includes a left side and a right side;

at least one left linkage for interconnecting the left side of the bridge member to the left side of the barrier, wherein the at least one left linkage is configured to be hinged to the left side of the bridge member and hinged to the left side of the barrier; and at least one right linkage for interconnecting the right side of the bridge member to the right side of the barrier, wherein the at least one right linkage is configured to be hinged to the right side of the bridge and hinged to the right side of the barrier;

wherein when the overhead gate system is assembled and installed, the at least one left linkage is not directly connected to the at least one right linkage, and a passage is at least partially defined between the at least one left linkage and the at least one right linkage and is distal the ground surface, is above the barrier, and permits physical access to and from the carport via the passage when the overhead gate system is in the deployed configuration.

* * * * *